US008413691B2

(12) United States Patent
Stead Faille et al.

(10) Patent No.: US 8,413,691 B2
(45) Date of Patent: Apr. 9, 2013

(54) SYSTEM TO TRANSPORT SOLIDS IN LIQUID MEDIA

(75) Inventors: Michael John Stead Faille, Santiago (CL); Peter Herbert Burger, Santiago (CL)

(73) Assignee: Andesocean S.A., Santiago (CL)

( * ) Notice: Subject to any disclaimer, the term of this patent is extended or adjusted under 35 U.S.C. 154(b) by 755 days.

(21) Appl. No.: 12/548,901

(22) Filed: Aug. 27, 2009

(65) Prior Publication Data

US 2010/0296879 A1 Nov. 25, 2010

(30) Foreign Application Priority Data

May 19, 2009 (CL) ..... 1234-2009

(51) Int. Cl.
*B65B 1/04* (2006.01)

(52) U.S. Cl. ..... 141/10; 141/114; 141/316; 220/495.03; 220/495.06

(58) Field of Classification Search ..... 141/10, 141/114, 313, 314, 316, 317; 220/495, 495.03, 220/495.06
See application file for complete search history.

(56) References Cited

U.S. PATENT DOCUMENTS

| | | | | |
|---|---|---|---|---|
| 3,834,591 | A | 9/1974 | Pirovano | |
| 4,468,812 | A | 8/1984 | Grosvenor | |
| 5,163,485 | A * | 11/1992 | Hermann | 141/10 |
| 5,468,117 | A * | 11/1995 | Lobko et al. | 414/809 |
| 6,286,700 | B1 * | 9/2001 | Davidson | 220/1.6 |
| 7,681,757 | B2 | 3/2010 | Rose et al. | |
| 2005/0264624 | A1 | 12/2005 | Ogura et al. | |
| 2007/0039974 | A1 * | 2/2007 | Lloyd | 222/105 |

FOREIGN PATENT DOCUMENTS

| | | |
|---|---|---|
| DE | 2 103 641 | 8/1972 |
| JP | 59-120022 | 7/1984 |
| JP | 6-87513 | 3/1994 |

* cited by examiner

*Primary Examiner* — Gregory Huson
*Assistant Examiner* — Jason K Niesz
(74) *Attorney, Agent, or Firm* — Hamre, Schumann, Mueller & Larson, P.C.

(57) ABSTRACT

A system to transport solids in liquid media, especially in the field of maritime and land transportation of fruits or vegetables in the agricultural produce area, or of any product having to be transported in liquid media for their protection against environment and the medium.

1 Claim, 4 Drawing Sheets

SYSTEM TO TRANSPORT SOLIDS IN LIQUID MEDIA

FIELD OF THE INVENTION

The present invention relates to a means to transport solids in liquid media, especially in the field of maritime and land transportation of fruits or vegetables in the agricultural produce area, or of any product having to be transported in liquid media for their protection against environment and the medium.

DESCRIPTION OF THE PRIOR ART

Presently, the transportation of fruits and vegetables that must be necessarily be moved within a liquid medium is carried out by manually placing said fruits and vegetables (or any other product as indicated in the foregoing paragraph) in such vessels as cans, buckets, plastic ibc containers, along with a liquid generally containing preserving and/or flavoring substances, by way of a funnels or manual vessels that get the content to the mouth of each vessel, then each of these containers is covered and, then, loaded, one by one, onto a truck or another means of transportation by loaders or pallet jacks or forklifts, the containers being carefully loaded and tied in order to prevent the containers from dumps and spills upon arriving at their destination, for example, at a packaging plant. The vessels are again unloaded from the truck by loading operators, pallet jacks or forklifts) and moved to the processing area, where the content is again removed from the vessels for being transferred to the production line.

SUMMARY OF THE INVENTION

The present invention provides a method of transporting fruits and vegetables and other products that must be necessarily stored and transported in protecting liquid media. This invention provides a novel solution comprising the use of a flexible tank that is introduced, empty, into in a container or tank car, the flexible tank being filled through a special opening located on its top and, the tank adapting itself to the inner contours of the marine container or tank car as it fills up until the solid-liquid mixture fills up the flexible tank, thus allowing a more rational use of loading space within the marine container or tank car, since the loading capacity would be increased with respect to the traditional method as described above, mainly because it prevents the typical interstices that necessarily form when using vessels, the volume of solid loaded being increased by 30% approximately.

On the other hand, the saving of labor related to loading and unloading is apparent, since the vessels do not have to be, one by one, be filled with the solid-liquid mixture; then close them, one by one, on the truck; then be opened and unloaded inside the processing area. The total cost of packing materials decreased considerably, as do the volume, weight and the handling of wastes from these materials.

Once the container has arrived, with the flexible bag in its interior, at its destination, its solid-liquid content is emptied by way of one or several exits located at the bottom or top of the flexible bag, preferably at the bottom of its side walls. To that purpose, a system adequate to each kind of product to be unloaded is used.

DETAILED DESCRIPTION OF THE INVENTION

Figure 1:
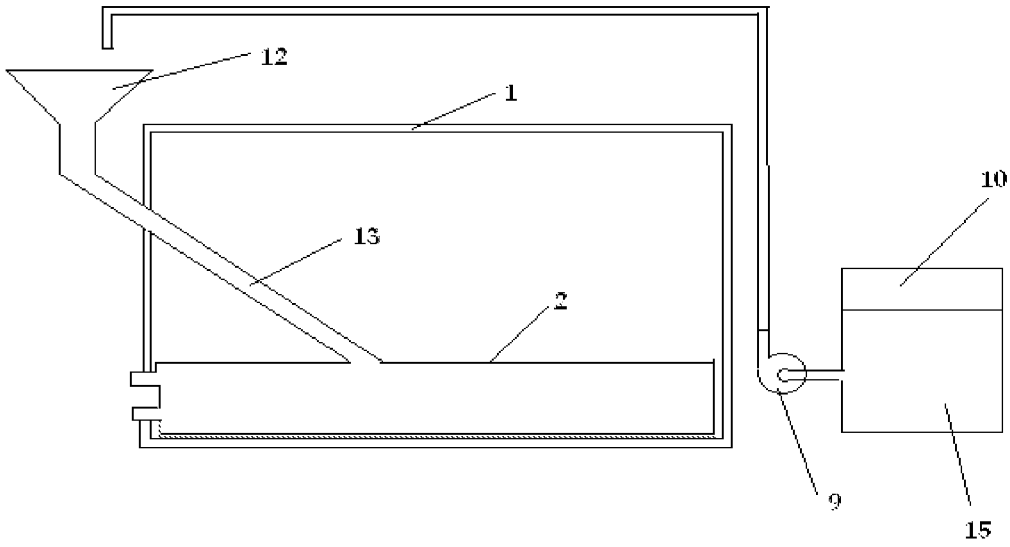
FIG. 1 shows the flexible bag when its filling is about to start, when an amount of liquid is injected to it in order to start the process.
Figure 2:
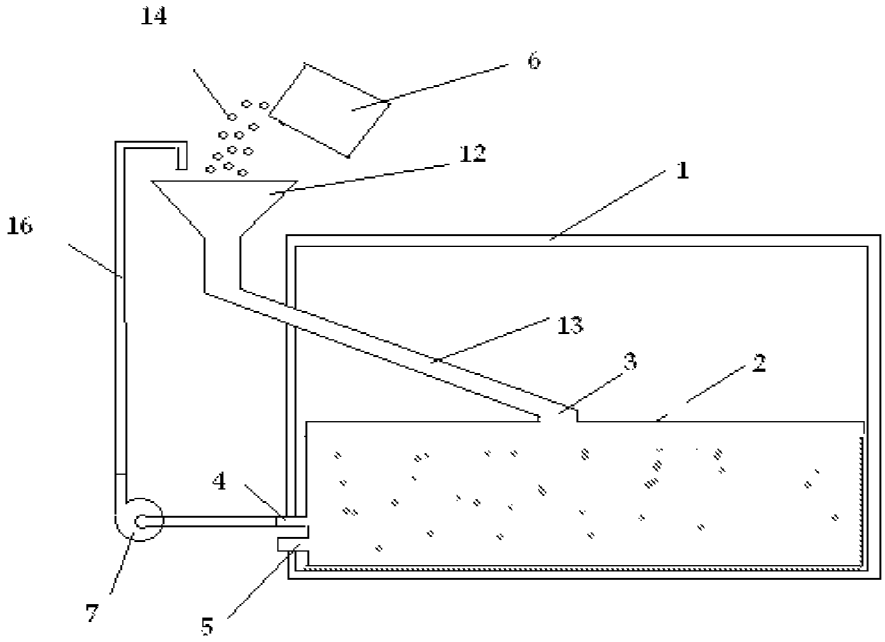
FIG. 2 shows the flexible bag inside the container when it is being filled.
Figure 3:
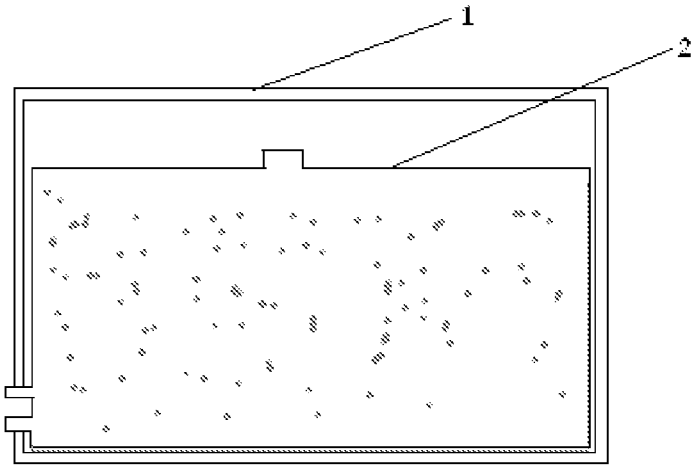
FIG. 3 shows the flexible bag inside the container during transportation.
Figure 4:
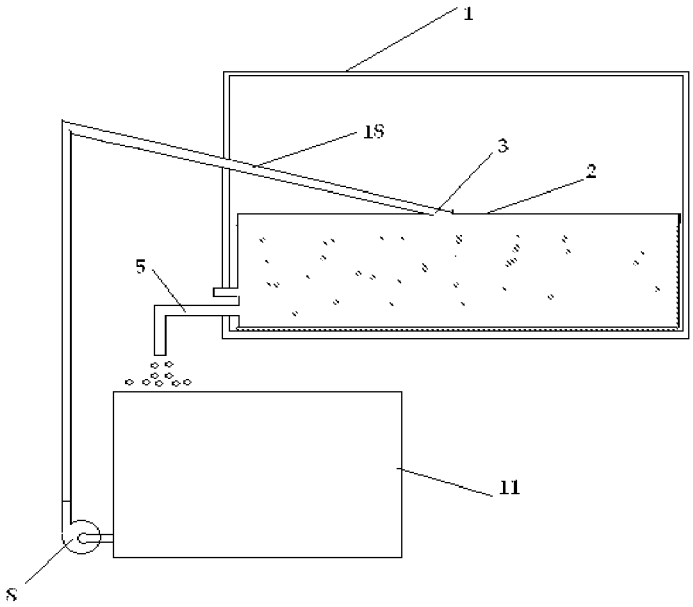
FIG. 4 shows the flexible bag inside the container during the unloading process.

The invention operates as follows:

A flexible tank (2) is placed inside a marine container or tank car (1) specifically on the floor of said container. The empty flexible bag is ideally laid on the entire floor of said container (1), care being taken that the floor of the marine (container or of the tank car (1) is free of sharp edges or elements that might tear or damage the bag when expanding as a result of the solid and/or liquid content it will be filled with. At an initial stage, as shown in FIG. 1, the liquid that will form the liquid part of the solid-liquid content is injected. To this effect, an external supply, such as the regular supply line or an external tank (10), is used, from which the liquid is pumped, by means of a pump (9), or any other means of liquid supply, to the flexible tank (2); the liquid is injected through the top liquid-solid intake (3) that is located on the top side of the flexible tank or at the bottom intake (4). Once the liquid content has been fully loaded, the external tank (19) and the pump (9) are disconnected, the filling of the flexible tank (2) being started, this process being able to be carried out together with the loading of solids into the flexible tank (2). To this effect, as is shown in FIG. 2, a feeding pipe (13), as well as top intake of the flexible tank (3) is introduced through the funnel (12) or via any system as required to load the specific product, as shown in FIG. 2, or through the bottom intake of the flexible tank (3) or through the bottom intake (4) the solid material (14), together with the liquid (15) that is removed by way of a pump or any other system, from a bottom outlet (4) located in the flexible tank, and is transported through a transportation pipe (16) to said funnel (12, silo or another suitable system for the product that is being loaded). Once the optimum filling level in the flexible tank (2) has been reached, all of the elements outside the container or tank car (1) and connected to the flexible tank (2) are removed, all of the intakes and outlets previously used being closed, thus the container or tank car (1) being ready to be transported as shown in FIG. 3. Once the container has reached its destination, it is unloaded as shown in FIG. 4. To this effect, liquid is retrieved from a target tank (11) wherein the solid-liquid content retrieved from the flexible bag (2) will be stored by setting up a pump (8) or the system that has been included for the specific product from the bottom outlet of the target tank (11) and will be injected into the top intake (3) by way of a hose (18) to assist the transportation of solids contained inside the flexible tank (2), the solid-liquid content of the flexible tank (2) exist through the bottom outlet (5) until its content is fully discharged into the target tank (11), which may also be another vessel where said content remains available for processing. Finally, the flexible tank (2) is removed empty from the interior of the container or tank car (1) being broken to remove any remains of the content that may have remained inside it. Then, the flexible tank (2) is disposed of. This system may have a heating system allowing to heat the liquid medium (that solidifies or otherwise) to facilitate the protecting medium (preserver) to flow together with the product that must be transported and protected.

What is claimed:

1. A method of using a system to transport solids in liquid media comprising the following steps:

at a loading point:

providing a container;

providing a flexible tank within the container, the flexible tank comprises:

at least one top intake located on a top side thereof to pump in solids, liquids, or a mixture thereof inside the flexible tank;

a first bottom outlet at a bottom part thereof allowing the discharge of solids and liquids;

a second bottom outlet at the bottom part thereof allowing the discharge or recirculation of liquids;

providing a medium to load the solids;

filling the flexible tank with the liquid that will be transported, along with the solid, by means of a pump and an external tank;

disconnecting the pump and external tank once the required amount of liquid has been pumped into the flexible tank;

connecting a hose to the second bottom outlet of the flexible tank to pump in liquid, which is poured through the top intake;

providing solids that are poured simultaneously with the liquid of the previous step through the top intake via a top feeding pipe;

once a maximum level of the flexible tank has been reached, sealing the top intake, removing the top feeding pipe, and sealing the bottom outlet;

after the flexible tank and the container have been transported to an unloading point, at the unloading point:

connecting a pump to a bottom outlet of a second tank to be filled and to the top intake of the flexible tank;

opening the first bottom outlet of the flexible tank for unloading;

pumping liquid from the bottom outlet of the second tank to the top intake of the flexible tank to help discharge the liquid-solid mixture through the first bottom outlet of the flexible tank;

once the discharge has been completed, disconnecting the pump from the bottom outlet of the second tank and the top intake of the flexible tank;

removing the flexible tank from the container and retrieving any solids may have remained inside the flexible tank; and disposing of the flexible tank.

* * * * *